US010494139B2

(12) United States Patent
Gauch et al.

(10) Patent No.: US 10,494,139 B2
(45) Date of Patent: Dec. 3, 2019

(54) METHOD AND DEVICE FOR PRODUCING TEAR-OFF LIDS AND TEAR-OFF LID

(71) Applicant: SOUDRONIC AG, Bergdietikon (CH)

(72) Inventors: Pascal Gauch, Berikon (CH); Peter Taiana, Widen (CH)

(73) Assignee: SOUDRONIC AG, Bergdietikon (CH)

( * ) Notice: Subject to any disclaimer, the term of this patent is extended or adjusted under 35 U.S.C. 154(b) by 350 days.

(21) Appl. No.: 15/304,904

(22) PCT Filed: Mar. 16, 2015

(86) PCT No.: PCT/CH2015/000042

§ 371 (c)(1),
(2) Date: Oct. 18, 2016

(87) PCT Pub. No.: WO2015/164986

PCT Pub. Date: Nov. 5, 2015

(65) Prior Publication Data

US 2017/0183121 A1 Jun. 29, 2017

(30) Foreign Application Priority Data

Apr. 29, 2014 (CH) ..... 643/14

(51) Int. Cl.

| | |
|---|---|
| ***B21D 51/38*** | (2006.01) |
| ***B21D 51/46*** | (2006.01) |
| ***B21D 51/44*** | (2006.01) |
| ***B65D 17/50*** | (2006.01) |

(52) U.S. Cl.

CPC ..... *B65D 17/502* (2013.01); *B21D 51/383* (2013.01); *B21D 51/443* (2013.01); *B21D 51/46* (2013.01); *B65D 2517/0013* (2013.01); *B65D 2517/5008* (2013.01); *B65D 2517/5056* (2013.01)

(58) Field of Classification Search

CPC .... B21D 51/383; B21D 51/443; B21D 51/46; B65D 17/502; B65D 2517/5056; B65D 2517/0013; B65D 2517/5008

USPC ..... 413/12, 13, 14, 15, 16

See application file for complete search history.

(56) References Cited

U.S. PATENT DOCUMENTS

| | | | | |
|---|---|---|---|---|
| 4,333,585 A * | 6/1982 | Del Bon | ..... | B21D 51/383 220/258.2 |
| 4,648,528 A * | 3/1987 | LaBarge | ..... | B21D 51/383 220/240 |
| 2013/0020326 A1* | 1/2013 | Thielen | ..... | B29C 45/1671 220/270 |

FOREIGN PATENT DOCUMENTS

| | | |
|---|---|---|
| DE | 92 03 953 U1 | 7/1992 |
| DE | 298 17 592 U1 | 11/1998 |
| EP | 0510488 A1 | 10/1992 |
| EP | 1153840 A1 | 11/2001 |

(Continued)

OTHER PUBLICATIONS

International Search Report for PCT Serial No. PCT/CH2015/000042 dated Jun. 15, 2015.

*Primary Examiner* — Jimmy T Nguyen

(74) *Attorney, Agent, or Firm* — McCormick, Paulding & Huber LLP

(57) ABSTRACT

A tear-off lid with a curled edge of the removal opening is formed such that before the edge is curled, a plastics layer provided as a band of low thickness and preferably only 0.1 mm thickness is applied to the collar of the lid ring. In this way, a good seal of the cut edge of the tear-off lid is produced economically and with the possibility for production at a high rate.

12 Claims, 7 Drawing Sheets

(56) References Cited

FOREIGN PATENT DOCUMENTS

| | | | |
|---|---|---|---|
| EP | 1626008 | A1 | 2/2006 |
| EP | 2 055 736 | B1 | 5/2011 |
| WO | 02/079041 | A | 10/2002 |
| WO | 2006/017953 | A1 | 2/2006 |
| WO | 2012129710 | A1 | 10/2012 |

* cited by examiner

METHOD AND DEVICE FOR PRODUCING TEAR-OFF LIDS AND TEAR-OFF LID

CROSS REFERENCES TO RELATED APPLICATIONS

This application claims the priority of Swiss patent application No. 643/14, filed Apr. 29, 2014, the disclosure of which is incorporated herein by reference in its entirety. The application is also a nationalization of PCT Application Number PCT/CH2015/000042 filed Mar. 16, 2015 which is incorporated herein by reference in its entirety.

FIELD OF THE INVENTION

The invention relates to a method and apparatus for producing tear-off lids and a tear-off lid produced according to the method and apparatus.

BACKGROUND OF THE INVENTION

Tear-off lids are known, for example, from DE-U 298 17 592 or from DE-U 92 03 953. A production of tear-off lids according to the prior art and known to a person skilled in the art will now be briefly described making reference to FIGS. 1 to 6. FIG. 1 shows a lid blank 1. Shown at the beginning of the transport route of a known production apparatus 20 is a stack 12 which contains a plurality of lid blanks of this type, said blanks being removed individually and processed by various processing stations along the transport route wherein initially lid rings are formed from the lid blanks and the lid rings are then further processed into the finished tear-off lid. The lid blanks are, for example, round disks made of coated metal which is thereby protected against corrosion, in particular coated tinplate. They have, for example, a diameter of 11 cm. These blanks have already been pre-formed at the edge 6 thereof by a processing machine (not shown) and the shaping of the edge 6 later serves for fastening the finished tear-off lid to a container or a can by means of a seam joint. This is known to a person skilled in the art and will not be described further here.

The conveying device 22 which conveys the lid blanks, the lid rings and the tear-off lids in the production apparatus 20 along the transport route in the direction of the arrow A from one processing station to the next processing station is provided in particular by two toothed belts which run in parallel and on which receptacles for the lid blanks or lid rings are provided, as is known to a person skilled in the art from WO 2006/017953. This also will not be described further here. At each of the processing stations according to the prior art, which are known to a person skilled in the art and are shown purely schematically here, each blank to be processed is lifted off the conveying device and is processed by the processing station and then returned to the conveying device. This is indicated at the processing stations with arrows pointing up and down. At the processing stations, the drive of the processing stations is indicated in each case under the conveying means. This serves to raise and lower the blanks and the lid rings and to carry out the respective processing steps.

In a stamping processing station 23, a lid ring 2 is formed from the lid blank 1 in that a central part 30 of the blank is cut out and disposed of as waste. In this way, the removal opening of the tear-off lid, which in a later production step will be closed with the tear-off film, is formed. A sealing flange 7 remains adjacent to the removal opening 15. At the cut edge 31, the metal material is bare and the sheet metal of the lid ring 2 is no longer protected there by the coating. In a processing station 24, the edge of the removal opening is pulled up to form a collar 4 and this collar is curled in a further processing station 25 so that a so-called "retort curl" 5 is formed. The form of the curl, or retort curl, can vary. The curl which forms the edge of the removal opening ensures that the user of the can is protected from the sharp cut edge when removing the contents of the can.

The production steps described so far were carried out in a position in which the lid blanks and lid rings were arranged with their later upper side or with the sealing flange 7, respectively, facing downwardly. This is also the preferred configuration in the present invention. As mentioned, the blank or the ring is lifted into the individual processing stations 23, 24 and 25 from the conveying device, processed and returned again, whereupon the conveying device carries out conveying steps which guide the lid blank or lid ring to the next processing station. If the production steps are carried out, as shown, with the sealing flange 7 facing downwardly, then a turning station 26 follows, which turns the lid rings such that during further processing, following the turning station, the sealing flange 7 lies in a position to face upwards in the conveying device 22 and in the processing stations.

Thereafter, the tear-off film 8 is sealed onto the sealing flange, and this can be carried out in two steps with a pre-sealing station 27 and a main sealing station 28. The sealing process is also known to a person skilled in the art and will not be described further here. Further processing stations can follow in which an embossing of the sealing foil can take place, the tear-off flap is positioned and a seal tightness test is carried out. This is also known to a person skilled in the art and will not be described further here. At the end of the known production apparatus 20, finished tear-off lids 10 are output, their removal opening 15 being spanned by a tear-off film 8 which is sealed onto the sealing flange 7. The edge of the removal opening 15 is formed by an upwardly and outwardly bent-over retort curl 5. The finished tear-off lid 10 can be fastened, by means of the fold edge 6 thereof, to a can body (which is indicated in FIG. 5 with a body wall part 11 only) and thereby closes the can. This is achieved during the filling operation after the can has been filled with a filling product. The can, once filled and closed, can be opened later in that the tear-off film is torn off from the lid ring by means of the tear-off tab 18, so that the removal opening 15 is opened. Tear-off lids of this type have proved to be effective.

If the container which is closed with the tear-off lid contains a liquid, corrosive filling product, for example, salt water, the bare cut edge 31 can corrode. Although, due to the upward and outward curl and with the covering by the tear-off film in the case of the tear-off lid as described with the retort curl, a certain degree of protection is provided against the influence of the filling product and the bare and possibly corroded cut edge is not visible as well, but depending on the aggressiveness of the filling product and on the storage time of the filled container, traces of the corrosion can nevertheless become visible. In EP-A 1 153 840, it is proposed that the tear-off film is also sealed onto the curl itself so that the cut edge is protected against the can contents by sealing. However, it has been found that sealing both on the sealing flange and also on the curl is barely achievable with reliability in production at a high production rate. WO-A 02/790041 mentions incidentally that the gap arising due to the curl can become filled with the hot seal coating of the tear-off film, but without explaining how this could actually be achieved during the industrial production of tear-off films. Known tear-off films are provided with only a very thin hot seal layer and it is not evident to a person skilled in the art how this layer could be used for gap filling when a hot sealing process known to the skilled person is used. The solution suggested in WO-A 02/790041 appears therefore to be unusable in practice. From EP-B 2 055 736, it is known to provide a container with an outward curl at the mouth of the container, so that the cut edge does not come into contact with water. It is proposed to provide protection of the cut edge there with a modified hot melt material which contains a thermoplastic elastomer.

SUMMARY OF THE INVENTION

It is an object of the invention to provide a method and a production apparatus for tear-off lids with which a tear-off lid can be made industrially at a high rate and at low cost, also having practically no corrosion of the cut edge, even with corrosive filling goods.

This object is solved with the aforementioned known method for producing tear-off lids in that before the curling of the free end of the collar, a band-shaped strip of plastics is applied to the inside of the collar.

By applying a band-shaped strip, the plastic material which reliably protects the cut edge against corrosion during the subsequent curling when forming the retort curl can be applied with little material cost and at a high speed.

It is preferable if the band-shaped strip is applied at an even thickness and particularly at a very low thickness, which amounts to only 0.05 mm to 1.0 mm. It is particularly preferable if the band-shaped strip is applied at a thickness of approximately 0.1 mm. The even thickness produces a good sealing effect during the curling and can save material and time during the coating. In particular, the preferred thickness range or the preferred approximate thickness of 0.1 mm results in a good sealing effect with a small material input and a high coating rate. It is herein preferable that the band-shaped strip is applied by spraying of a liquid plastics material onto the lid ring, so that the operation can be carried out rapidly and with a high degree of evenness. Preferably, the plastics is a plastic material liquefied by melting and particularly a thermoplastic elastomer liquefied by melting. This results in the desired even and thin coating. The height of the band can amount, for example, to from one millimeter to several millimeters and is not critical if it is ensured, during the curling, that the curl comes into contact with the band.

Preferably, the plastics is applied onto the rotating lid ring by a spray nozzle which is stationary during the coating. This variant is mechanically simple and is readily manageable for the desired accuracy. However, it is also possible to operate with a rotating spray nozzle and a lid ring held stationary. In particular, the desired even thickness can be achieved if, during the spraying on, the distance between the spray nozzle and the lid ring is kept constant. This is preferably provided by arranging the lid ring horizontally displaceable on its support and in that the outside of the collar of the lid ring is acted upon by at least one roller in order to keep the spacing of the inside of the collar from the spray nozzle constant, since the precisely and fixedly positioned rotatable roller defines the position of the collar relative to the spray nozzle. This enables a mechanically simple solution which allows the precise application of the band-shaped strip with even thickness. Solutions in which the spacing of the spray nozzle is continuously adjusted, by means of a distance measurement and a displacement of the spray nozzle, to the not exactly centrally rotating lid ring are also possible, although the claimed mechanically simpler solution is preferred.

It is a further object of the invention to provide a production apparatus for tear-off lids, by means of which tear-off lids can be manufactured at a high rate and economically, but which does not have the above-mentioned disadvantage.

This object is achieved with the apparatus having the features described hereinafter.

Through the provision of a coating station with which a peripheral band-shaped plastics layer can be applied to the inside of the collar of the lid rings, the protection of the curled cut edge is enabled since the curl contacts the plastics layer which forms a seal.

Preferably, the apparatus according to the claim is designed such that the coating station is configured for applying a band-shaped plastics strip which has a substantially even thickness, particularly a thickness in the range from 0.05 mm to 0.5 mm and particularly a thickness of approximately 0.1 mm. This embodiment provides good protection with a low material use and very high processing speed so that the coating station can operate at the same rate as the other processing stations of the apparatus. It is also preferred that the coating station has a rotatably drivable receptacle for a lid ring and a spray nozzle which is stationary during the application of the band in order to apply the plastics in a liquid form and band-shaped onto the rotatingly driven lid ring by means of the spray nozzle, which comes to lie in the coating station within a lid ring placed on the receptacle when the lid ring has been lifted from the conveying device by the coating station. This results, reproducibly, in the desired plastics layer of low thickness.

Preferably, the plastics is liquefied in that the coating station is equipped with an extruder, with a heated supply line to a controllable valve and a heated valve, so that the spray nozzle can be supplied by means of the valve with the melted plastics for the application thereof under pressure. Preferably, the support or receptacle, respectively, for the lid ring is also displaceable horizontally relative to its rotational axis against the force of a spring and at least one roller is provided, the rotational axis of which extends parallel to the rotational axis of the receptacle, wherein the roller is arranged at least partially coplanar with the receptacle and extends into the region which, with the lid ring lifted, is encompassed thereby. By this means, the outside of the collar of a lid ring situated on the support can be acted upon by the roller if the lid ring is lifted and, since the position of the roller is precisely defined, the horizontal position of the lifted lid ring is also precisely defined. This enables, by simple means, the spacing of the inside of the collar of the lid ring from the spray nozzle to be kept constant, which leads to the desired constant thickness of the plastics coating on the inside of the collar. In order to undertake the application of the band, the spray nozzle is moved toward the rotating lid ring, the position of which is defined horizontally by the roller and, following the coating, is moved away again.

It is a further object of the invention to provide a tear-off lid which does not have the above-mentioned disadvantages and can be economically manufactured industrially at a high rate and quality.

This object is achieved with the tear-off lid having the features described hereinafter.

Preferably, the thickness of the band-shaped seal is between 0.05 mm and 0.5 mm and, in particular, is approximately 0.1 mm. The height of the seal can be 1 mm to 3 mm.

BRIEF DESCRIPTION OF THE DRAWINGS

Further embodiments, advantages and uses of the invention are disclosed by the dependent claims and the following description making reference to the drawings, in which:

DESCRIPTION OF THE PREFERRED EMBODIMENTS

In the introductory part, the production of tear-off lids according to the prior art as known to a person skilled in the art was described, making reference to FIGS. 1 to 6. For the avoidance of repetition, reference is made here to this description.

The procedure according to the invention will now be described, wherein reference is made, where necessary, to the known apparatus and the known, production steps described above. In particular, in the apparatus and the method according to the invention for forming the lid ring from the lid blank and for the sealing of the tear-off film, the procedure as already known to a person skilled in the art is carried out.

Figure 1:
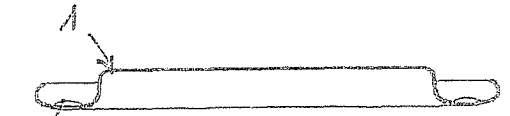
fig. 1 PRIOR ART
FIGS. 1 to 5 are vertical sectional views through a lid blank, a lid ring and a tear-off lid to illustrate processing steps in the formation of a tear-off lid according to the prior art.
Figure 2:
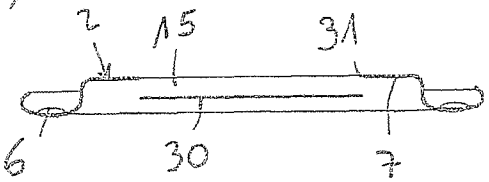
fig. 2 PRIOR ART
Figure 3:
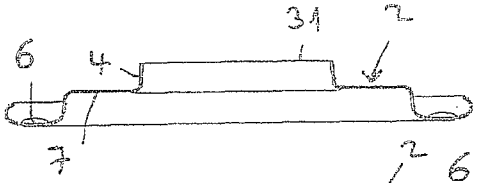
fig. 3 PRIOR ART
Figure 4:
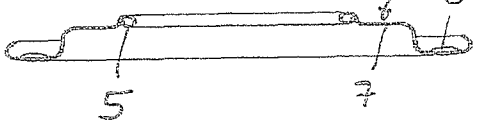
fig. 4 PRIOR ART
Figure 5:
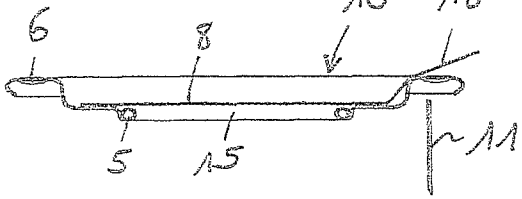
fig. 5 PRIOR ART
Figure 6:
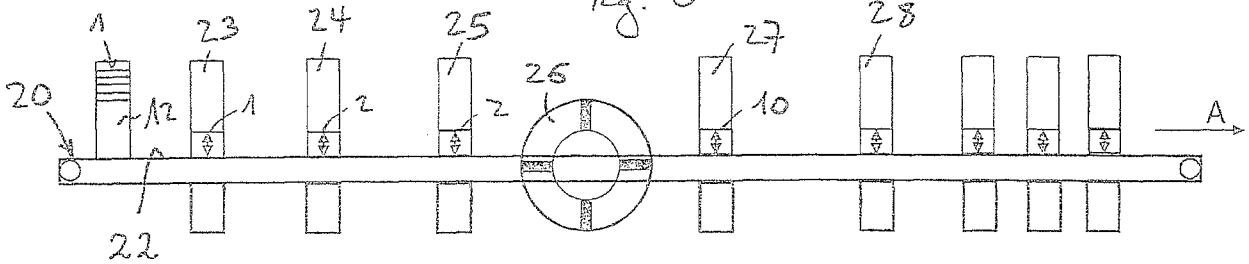
fig. 6 PRIOR ART
FIG. 6 is a schematic side view of an apparatus according to the prior art for producing tear-off lids or for carrying out the steps according to FIGS. 1 to 5.
Figure 7:
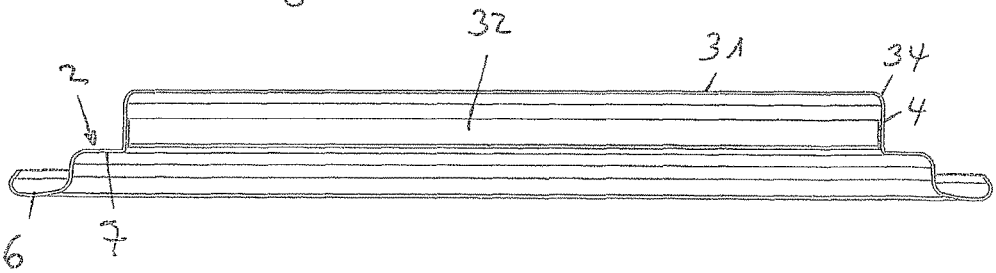
FIG. 7 is a vertical sectional view of a lid ring during the production of a tear-off lid according to the invention.
Figure 8:
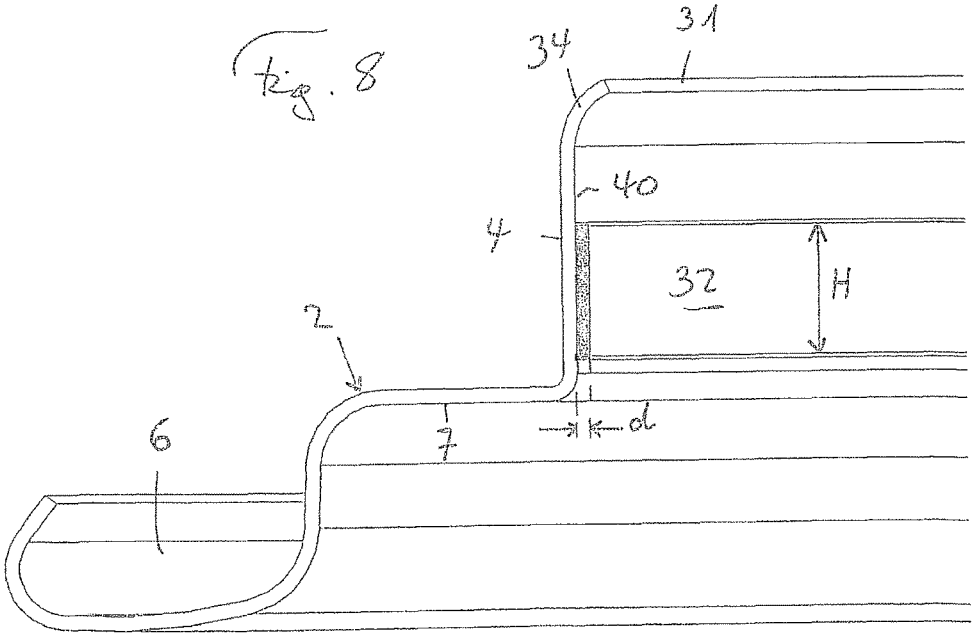
FIG. 8 is an enlarged view of a portion of the lid ring of FIG. 7.
Figure 9:
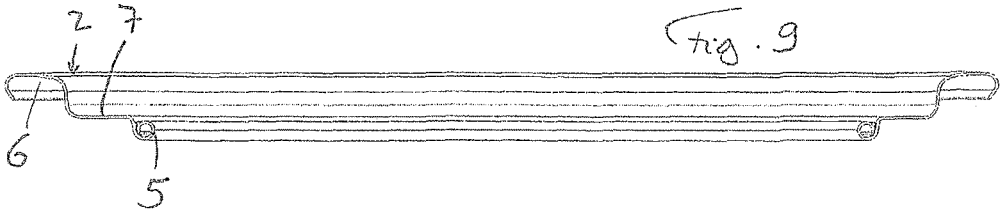
FIG. 9 is the lid ring of FIG. 7 after curling of the edge of the removal opening.
Figure 10:
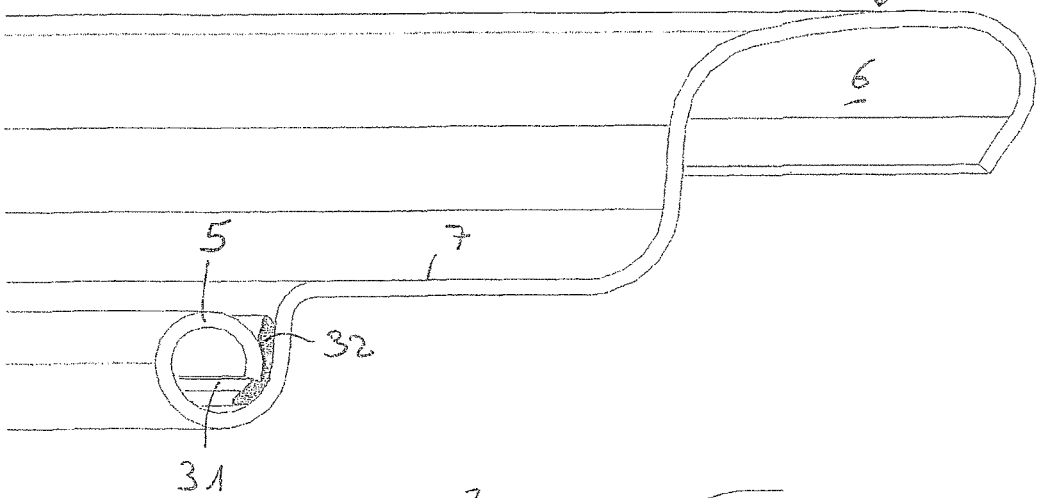
FIG. 10 is an enlarged view of a portion of the lid ring of FIG. 9.
Figure 11:
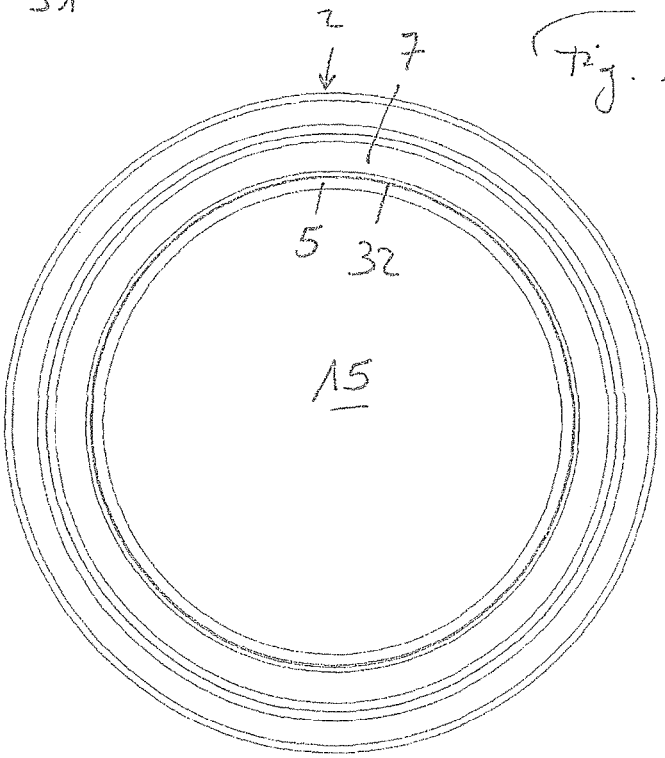
FIG. 11 is a plan view of the lid ring of a tear-off lid according to the invention.
Figure 13:
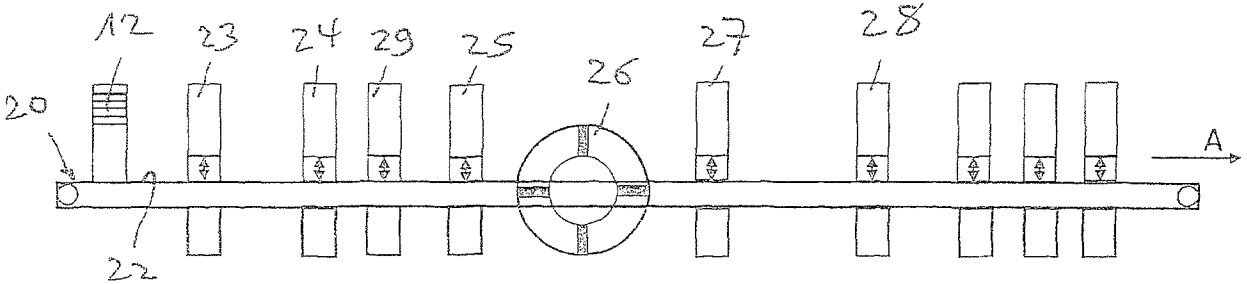
FIG. 13 is a schematic side view of an apparatus according to the invention for producing tear-off lids with a sealed cut edge.

FIGS. 7 and 8 show a lid ring wherein the processing step of drawing the edge of the removal opening to form the collar 4 has already taken place. This has been performed in the processing station 24. In the preferred example according to the invention as shown, herein (or in a separate step) an inward curvature which facilitates the later curling to form the retort curl has been created at the upper end 34 of the collar 4. According to the invention, in an operation at the inside 40 of the collar 4, a plastics layer in the form of a band 32 is applied. The application of this plastics layer is preferably carried out in a separate processing station 29, as shown in FIG. 13. This processing station 29 is arranged between the drawing station 24 and the curling station 25.

During curling, the band 32 made of the plastics layer forms a seal for the cut edge 31, as will now be described. The band 32 consists of a plastics material and is preferably made of a thermoplastic elastomer (TPE). TPE plastics of this type are commercially available, particularly in qualities which reliably resist the sterilization temperature during sterilization of the filled container, so that the seal formed by the band is retained during the sterilization. As shown, the band is preferably formed with uniform thickness over the whole height of the band. It is provided as a thin band which preferably has a thickness d in the range of 0.05 millimeters to 0.2 millimeters, and preferably a thickness of approximately 0.1 millimeters. The height H of the band can be, for example, 1 mm to 3 mm.

The coating according to the invention takes place by means of the spraying-on of a melted, liquid plastics material, preferably the aforementioned TPE, wherein a relative movement of the nozzle and the lid ring takes place. Preferably, the lid ring is rotatingly moved in the processing station 29 (FIGS. 12 and 13) and the inside 40 of the collar 4 is moved past the exit opening of a spray nozzle from which the plastics material emerges and which nozzle is arranged to be static during the coating. Thus, the lid ring is lifted at the processing station 29, caused to rotate and the coating is activated when the lid ring has reached the right position relative to the exit opening of the nozzle. Following at least one full rotation, if a gapless peripherally extending band is formed at the inside, the lid ring with the band 32 is again moved downwardly to the conveying device, wherein the rotation is ended so that the lid ring can again be placed on the receptacles of the conveying device. Then follows the conveying to the curling station 25. The plastics material of the band 32 already starts to cool down during the coating onto the lid ring and solidifies so that during further conveying, no flowing of the plastics takes place and the band is stable in the form shown. If necessary, in the coating station or the processing station 29, a cooling means, e.g. in the form of a blower can be provided.

The lid ring can be rotated at a high speed during the coating of the thin plastics band, wherein this should be understood to include a rotation of more than 200 rotations per minute. A preferred rotational speed lies in the range of 400 per minute to 600 per minute.

During the coating, it is ensured that the spacing of the application opening or of the spray nozzle from the inside 40 of the collar 4 during spraying on of the liquid plastics remains substantially constant so that the thickness of the band 32 is substantially constant and the low thickness thereof is possible. This can be achieved, for example, in that the lid ring 2 is precisely centered in the processing station 29 on a receptacle and the spray nozzle with the application opening has a defined spacing relative to this receptacle. However, the transfer from the conveying means with subsequent centering requires time so that, for the very high production rates striven for, the procedure followed is preferably such that the lid ring is pressed in the processing station with the outside of the collar 4 against a roller which is precisely positioned relative to the injection nozzle position during the coating, so that the spacing of the spray nozzle from the inside 40 of the collar 4 is precisely defined by simple means. This will now be described in greater detail making reference to FIG. 9 and FIGS. 14 to 17 and 18 to 21.

It is evident that the band 32 is positioned at the inside 40 of the collar 4 such that it lies closer to the plane of the sealing flange 7 than to the cut edge 31. The positioning and dimensioning of the band is approximately such that the band 32 covers the lower third of the collar 4 to the lower half of the collar 4. It is possible for the band to have a greater height H, although the material cost for the plastics used then increases, but this is not necessary for the further processing or for protection of the cut edge. In practice, the height H of the seal can be approximately 1 mm to 3 mm.

The lid ring provided with the plastics band according to FIGS. 7 and 8 is provided in known manner in the processing station 25 with a retort curl 5. This station 25 operates according to the prior art with the known curling tools, so that this need not be described in detail here, being known to a person skilled in the art. A modification which is obvious to a person skilled in the art is possibly present in the tools if the collar 4 has already been bent forward at its upper edge 34 for the curling, which is preferable. It is evident, according to FIGS. 10 to 13 which show the lid ring after the turning station 26 and particularly considering FIG. 12, that during the formation of the retort curl 5, the band 32 forms a seal which prevents the entry of liquid to the interior of the retort curl. Thus the bare cut edge 31 is protected against the influence of a liquid present in the can. It is unimportant whether the curling takes place in such a way that the cut edge 31 is partially embedded in the band 32, as shown or whether it only lies against the band 32. Also the opposite, that the cut edge 31 cuts through the band 32 and lies against the metal of the inside 40 does not disturb the function of the band 32. Thus, the normal production tolerances in the formation of the retort curl 5 play no part. The plan view 12 shows the lid ring as it is transported into the sealing station 27 in which the tear-off film is sealed on over the removal opening.

FIG. 13 shows the production apparatus 20 for the tear-off lid, in which a processing station 29 is provided for the coating of the band 32 on the lid ring. The processing station 29 is preferably configured according to FIG. 12 and FIGS. 14 to 21.

Figure 12:
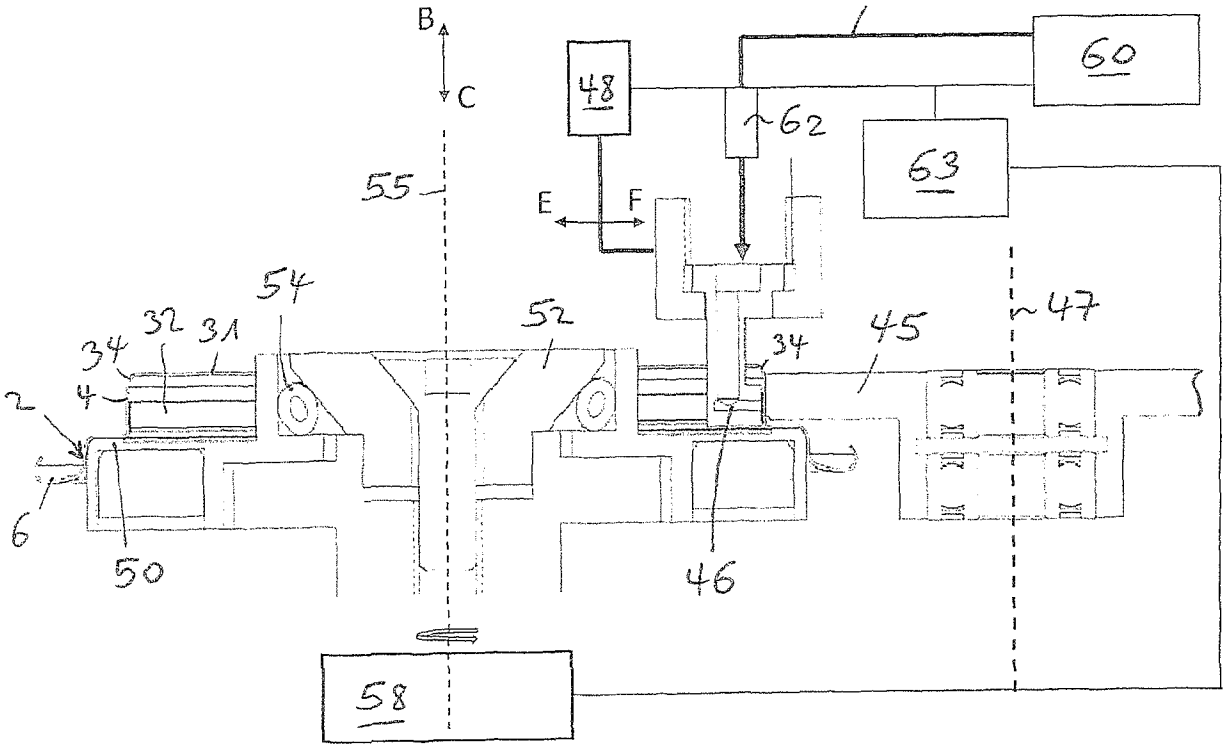
FIG. 12 is a schematic representation of the processing station for applying the seal.

FIG. 12 shows a support 50 which is adapted, in its diameter and form, to the lid rings 2. A lid ring 2 lies with its sealing flange 7 against the upper side of the support 50. The support 50 can be moved up and down in a known manner as with the other processing stations, so that the support can be moved downwardly in the direction of the arrow C in the drawing, by which means the support is lowered beneath the receptacles for the lid ring of the conveying device 22, such that the lid ring is again passed to the conveying device so that it can be transported to the next processing station 25. On the other hand, the next lid ring which is to be received into the processing station 29 is taken up by the receptacle 50 or is lifted off the conveying device when the receptacle 50 is moved upwardly again in the direction of the arrow B. This is fundamentally known to a person skilled in the art in a similar manner from the other processing stations and the drive for moving the support 50 up and down is shown only schematically as a box 58. This drive can be configured in known manner electrically and/or pneumatically.

In the preferred processing station 29, the support 50 is displaceable resiliently in the horizontal direction of the arrow E-F relative to the vertical central axis 55. This can be carried out in various ways and in the present example is solved in that a central conical holder 52 is provided which lies fixed in the position of the central axis 55 (but is rotatable thereabout, as will be explained below) and in that elastic spring means, for example, in the form of a peripheral plastics hose 54 is provided which enables the support 50 to move in the direction of the double arrow E-F by a few tenths of a millimeter to millimeters horizontally or perpendicularly to the central axis 55, respectively. In this way, the lid ring can also be displaced by this amount in the direction of the double arrow. The spray nozzle 46 which sprays the plastics material to form the band 32 against the inside 40 of the collar 4 of the lid ring 2, however, is arranged fixed in its coating position (but displaceable into the coating position, as will be described below). The spacing of the spray nozzle 46 from the inside 40 is kept constant during the application of the plastics material in that a roller 45 which is rotatable about a vertical rotary axis is arranged adjoining the support 50. The position of the rotary axis 47 in the processing station 29 is fixed and is defined relative to the spray nozzle in the application position thereof, such that the plastics coating is carried out at a defined thickness.

The displacement drive 48 by means of which the spray nozzle 46 is displaceable in the direction of the double arrow E-F is shown as a box and is, for example, configured as an electric motor or as electromagnetic or pneumatic. This displacement of the spray nozzle is shown more exactly on the basis of FIGS. 14 to 21.

Figure 15:
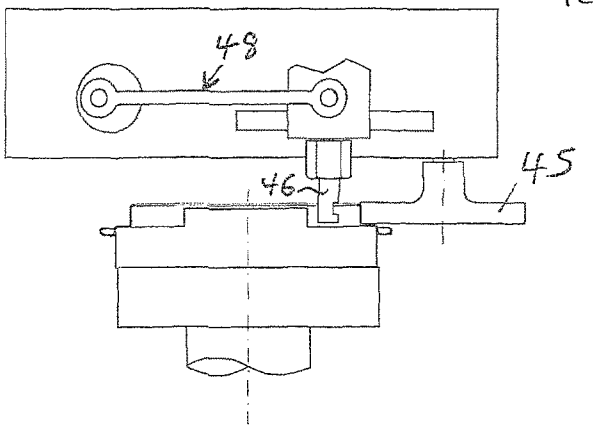
FIGS. 14 to 17 are illustrations of the positioning of the lid ring in the processing station and the movement of the spray nozzle in a preferred embodiment.
Figure 14:
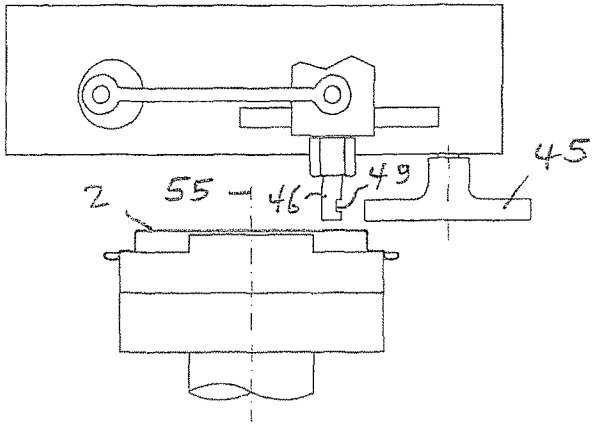
Figure 19:
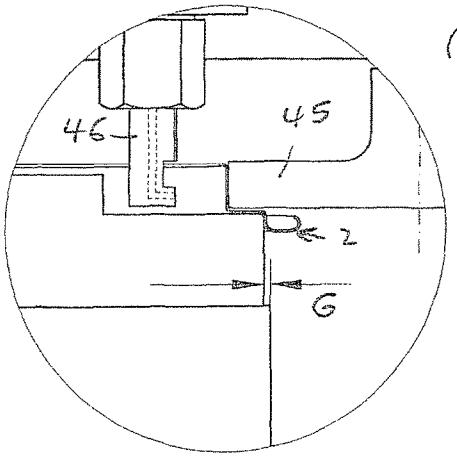
FIGS. 18 to 21 are enlarged illustrations of the positioning of the spray nozzle for the application of the plastics.
Figure 18:
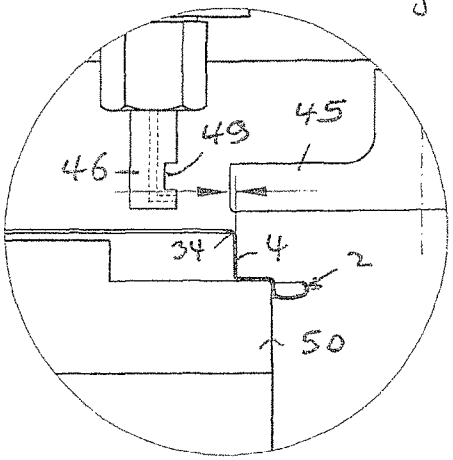

When the support 50 is raised, the lid ring 2 is positioned centrally to the axis 55 by the spring means 54. The spray nozzle 46 has been positioned by its drive 48 displaced toward the axis 55 or in the direction E, as shown in FIGS. 14 and 15 and FIGS. 18 and 19. In this position, on lifting in the direction of the arrow B, the spray nozzle will enter into the lid ring 2. For the preferred inwardly facing curvature of the edge 34 of the collar 4 also, there is sufficient space and the spray nozzle is not a hindrance in this moved back position for the lifting movement of a lid ring of this type. The lid ring 2 or the support 50 and holder 52 of the support is brought into rotation about the axis 55 by the drive 58, for example, at the above-mentioned rotary speed of 600 per minute. At the end of the lifting movement of the lid ring 2, the lid ring makes contact with the outside of its collar 4 against the outside of the roller 45, since the roller 45 is arranged in the processing station such that it extends into the region encompassed by the raised lid ring. The FIGS. 14 and 18 show the position during lifting shortly before the collar 4 touches the roller 45. The FIGS. 15 and 19 show the position in which the lifting movement is completed and the collar 4 lies against the roller 45. Since the position of the roller 45 in the processing station 29 is precisely defined in the horizontal direction, the position of the collar 4 where it touches the roller 45 is also precisely defined. Thanks to the spring means 54, the lid ring can be adjusted in the horizontal position such that the lid ring assumes the position of the roller 45. However, the roller 45 is rotatable but not driven itself since it takes on the rotation of the lid rings.

Figure 17:
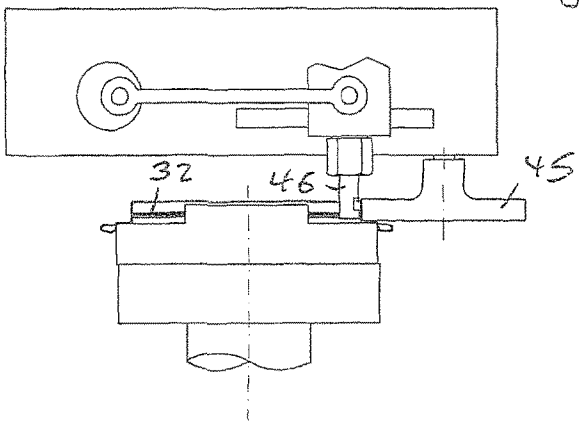
Figure 16:
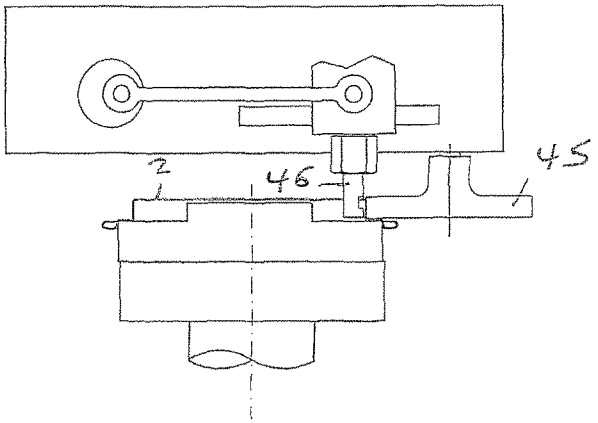
Figure 21:
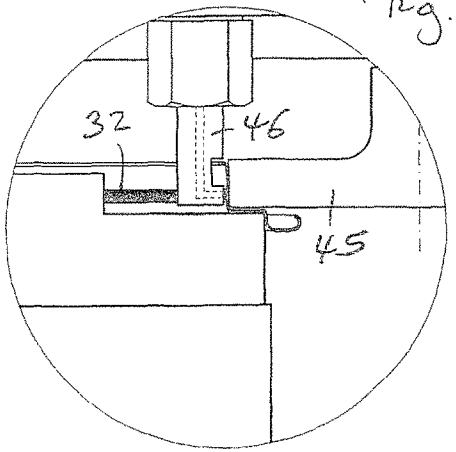
Figure 20:
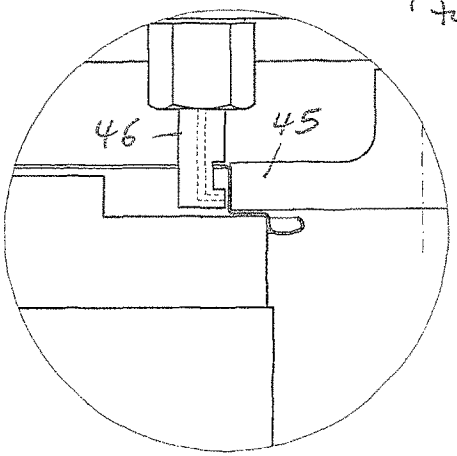

Once the lifting is ended and once the lid ring has thus reached the position shown in FIGS. 12, 15 and 19, the spray nozzle 46 is moved by its drive 48 in the direction F and assumes its fixed application position. Since the position of the roller 45 in the processing station has been precisely defined in its distance from the spray nozzle, the inside 40 of the collar 4 is also positioned at a precise spacing relative to the spray nozzle for the spraying-on of the plastics material onto the inside 40, when the spray nozzle 46 has reached its end position in the direction F, as shown in FIGS. 16 and 20. The recess 49 in the spray nozzle 46 enables the approach of the spray nozzle 46 to the collar 4 despite the curvature of the collar at the end 34. Once the spray nozzle 46 has reached its end position, the spraying-on is started and takes place throughout a complete rotation (or, if required, a plurality of full rotations) of the lid ring. FIGS. 12, 17 and 21 show the spraying-on by the spray nozzle. In this way, the band 32 of plastics is made in a precisely selectable thickness. The height H of the band 32 depends on the selection of the spray nozzle. The spraying-on of the plastics is stopped and the spray nozzle 46 is moved back by its drive 48 in the direction of the arrow E. Furthermore, the rotation of the support 50 and the holder 52 is ended and the support 50 is moved downwardly in the direction of the arrow C, wherein the lid ring loses contact with the roller 45 again. The lid ring 2 equipped with the band 32 is again laid on the conveying means and the next conveying step takes place and conveys the lid ring equipped with the plastics band 32 to the next processing station 25.

The supply of liquid melted TPE plastics to the spray nozzle 46 can take place in a fundamentally known manner in that the plastics is melted in an extruder 60 and is extruded and, for example, is fed through a heated hose line 61 in liquid form and under pressure to the processing station. This is indicated purely schematically with lines so that the actual embodiment of the entry of the line into the head containing the spray nozzle is not shown. A controllably openable and closable valve 62 which is also preferably heated, causes the start and the end of the spraying of the plastics. A control system 63 can control the outlined sequence of the lifting from the conveying means, the rotation of the support with the lid ring about the axis 55 and the displacement of the spray nozzle 46 and the start of spraying and the ending of spraying and the withdrawal of the spray nozzle, the ending of the rotation and the lowering of the support. This control system can be a control unit provided at the processing station 29 or is a joint control unit common to a plurality of, or all, the processing stations and the conveying means 22.

The aforementioned FIGS. 14 to 17 show an example of the drive 48 of the spray nozzle 46 in more detail. This is movable horizontally in a linear guide in the direction E-F, which is brought about here by means of an eccentric drive. In FIGS. 18 to 21, the positioning of the spray nozzle relative to the inside of the collar 4 is shown enlarged. The channel for the plastics in the interior of the spray nozzle 46 is also shown with dashed lines. The displacement of the support 50 and thus of the lid ring 2 on contact of the lid ring with the outside of the roller 45 is indicated in FIG. 19 with the arrows G.

Whilst in the present application, preferred embodiments of the invention are described, it should be made clear that the invention is not restricted thereto and can also be carried out in other ways within the scope of the following claims.

What is claimed is:

1. A method for producing tear-off lids, wherein from a lid blank a lid ring having a central removal opening which is surrounded by a sealing flange is formed by means of a punching process;

the edge of the central removal opening is formed by drawing to a collar projecting away from the sealing flange;

the collar is curled at the free end thereof;

a tear-off film is sealed onto the sealing flange; and wherein before the curling of the free end of the collar, a band-shaped strip of plastics is applied to the inside of the collar.

2. The method as claimed in claim 1, wherein the band-shaped strip is applied at an even thickness.

3. The method as claimed in claim 1 wherein the band-shaped strip is applied at a thickness which amounts to 0.05 mm to 0.5 mm.

4. The method as claimed in claim 1, wherein the band-shaped strip is applied by spraying a liquid plastics material onto the lid ring.

5. The method as claimed in claim 4, wherein the plastics is a plastics liquefied by melting.

6. The method as claimed in claim 4 wherein the plastics is applied onto the lid ring while the ring is rotated, by spraying plastics from a spray nozzle which is held stationary in a coating position at a distance from the lid ring.

7. The method as claimed in claim 6, wherein, during the spraying, the distance between the spray nozzle and the lid ring is kept constant.

8. The method as claimed in claim 7, wherein during the spraying, the lid ring is held horizontally displaceable and in that the outside of the collar is acted upon by at least one roller in order to keep a spacing of the inside of the collar from the spray nozzle constant.

9. The method as claimed in claim 1, wherein, in order to apply the band-shaped strip of plastics, the lid ring lying horizontally is lifted in a lifting movement and toward the end of the lifting movement is acted upon by a horizontally immovably positioned roller, in that after the lifting, a spray nozzle is moved toward the inside of the collar, in that after positioning the spray nozzle, the spraying of the plastics onto the lid ring in a peripheral band takes place while the lid ring is rotatably driven, in that after application of the peripheral band, the spray nozzle is moved away from the inside of the collar and in that the lid ring is lowered toward a conveying device.

10. The method as claimed in claim 1, wherein when the collar is formed, the free end of the collar is curved inwardly.

11. The method as claimed in claim 2, wherein the band-shaped strip is applied at a thickness which amounts to 0.05 mm to 0.5 mm.

12. The method as claimed in claim 2, wherein the band-shaped strip is applied by spraying a liquid plastics material onto the lid ring.

* * * * *